United States Patent [19]

Schlage

[11] 4,114,411

[45] Sep. 19, 1978

[54] AUGMENTED KEY AND CYLINDER LOCK

[75] Inventor: Ernest L. Schlage, Burlingame, Calif.

[73] Assignee: Schlage Lock Company, San Francisco, Calif.

[21] Appl. No.: 774,784

[22] Filed: Mar. 7, 1977

[51] Int. Cl.[2] ..... E05B 9/04; E05B 19/04

[52] U.S. Cl. ..... 70/421; 70/375; 70/408

[58] Field of Search ..... 70/421, 419, 364 R, 70/364 A, 373, 375, 406, 408

[56] References Cited

U.S. PATENT DOCUMENTS

| | | | |
|---|---|---|---|
| 1,958,603 | 5/1934 | Bacon | 70/421 |
| 3,216,230 | 11/1965 | Falk | 70/421 |
| 3,425,248 | 2/1969 | Duval | 70/421 |
| 3,774,423 | 11/1973 | Orr | 70/408 |
| 3,861,181 | 1/1975 | Needham | 70/406 |

FOREIGN PATENT DOCUMENTS

| | | | |
|---|---|---|---|
| 1,533,953 | 6/1968 | France | 70/421 |

*Primary Examiner*—Robert L. Wolfe
*Attorney, Agent, or Firm*—Lothrop & West

[57] ABSTRACT

An augmented key and cylinder lock has a housing with a bore therein concentric about an axis. A plug in the bore is rotatable about the axis and has a flange on one end. There is a radial pin tumbler mechanism in the plug and housing access to which is afforded by a keyway in the plug which extends through the flange leaving a notch therein. A key serrated along one edge to operate the pin tumbler mechanism is receivable in the keyway to occupy an operating position. In that position, a shoulder adjacent the serrated edge of the key substantially abuts the end face of the flange. In that position another, axially elongated shoulder on the key adjacent its other edge axially displaces a spring pressed detent, supported on the housing, out of the notch. This frees the plug from rotational restraint by the detent.

2 Claims, 7 Drawing Figures

FIG-1
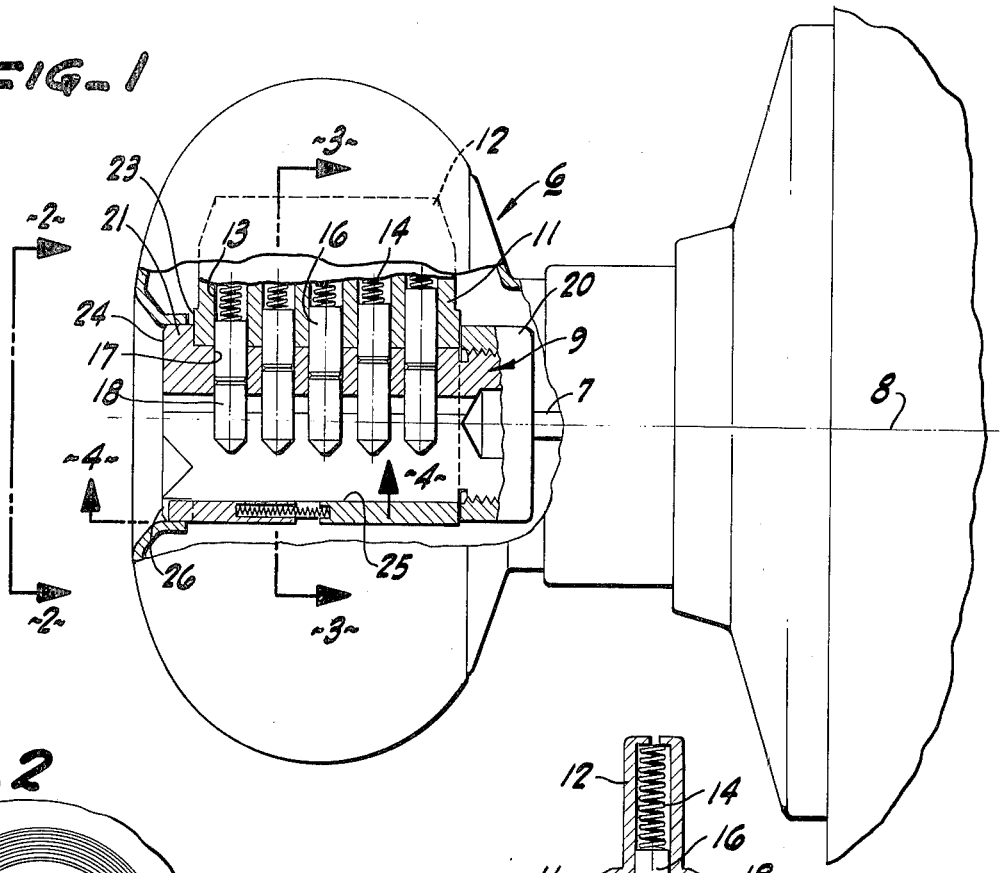
FIG-2
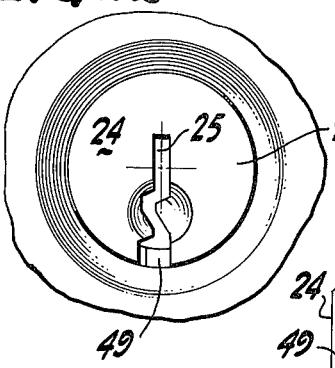
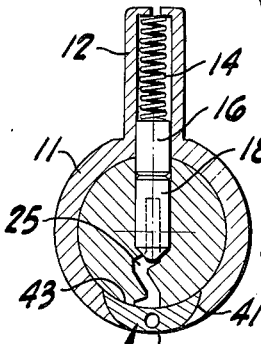
FIG-3
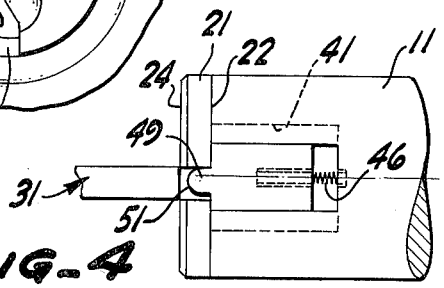
FIG-4
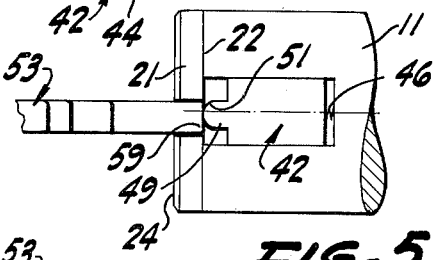
FIG-5
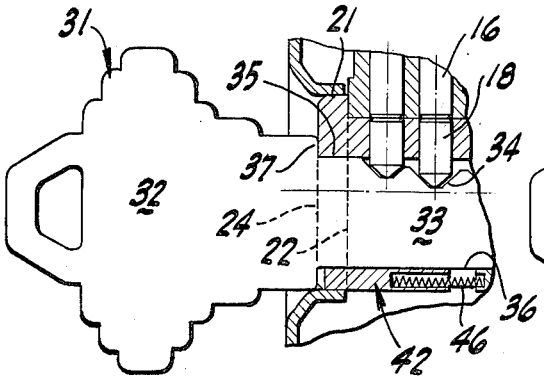
FIG-6
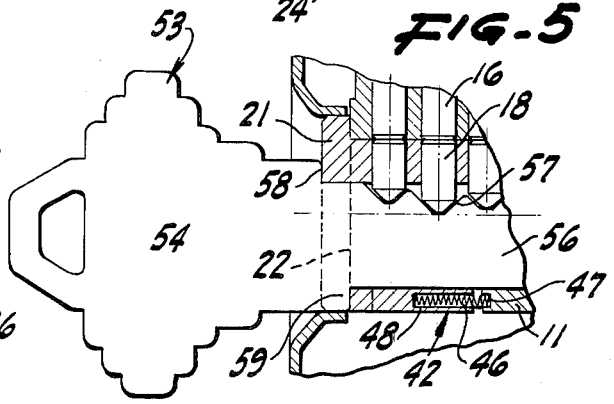
FIG-7

AUGMENTED KEY AND CYLINDER LOCK

BRIEF SUMMARY OF THE INVENTION

In line with affording increased security in locking mechanisms and also to increase the number of possible key combinations that can be utilized, the customary pin tumbler installation in a housing with a rotatable plug therein is augmented by utilizing on the housing an axially movable detent. The detent is spring pressed so that at least part of it engages a notch in an end flange on the plug formed by the passage of the customary keyway in the plug through the flange. A key for use in this mechanism has a customary serrated edge to actuate the pin tumbler mechanism when the key is in operating position in the keyway and also has a shoulder adjacent the serrated edge of the key adapted substantially to abut the end face of the plug. In addition, the key has an augmented or axially extending additional shoulder along its other edge. The latter shoulder is long enough to displace the detent from the notch against spring pressure when the key is in full operating position in the keyway. The result is that some ordinary, unaugmented keys which are properly serrated to operate the combination nevertheless cannot produce rotation of the plug, since the notch-engaging detent prevents such rotation. However, an augmented or special key having an extended shoulder can, when fully positioned, displace the detent from the notch and allow full plug rotation with respect to the housing.

BRIEF DESCRIPTION OF THE SEVERAL VIEWS OF THE DRAWINGS

FIG. 1 is in part a side elevation of a customary knob containing a lock mechanism, a portion being broken away to show on a vertical, axial plane the interior construction of the lock mechanism constructed pursuant to the invention.

FIG. 2 is a view with portions broken away, the view being taken on the plane indicated by the line 2—2 in FIG. 1.

FIG. 3 is a cross-section, with portions omitted, the plane of section being indicated by the line 3—3 of FIG. 1.

FIG. 4 is a view from below with portions broken away, one form of key being in position and the plane of the view being indicated by the line 4—4 of FIG. 1.

FIG. 5 is a view comparable to FIG. 4 but showing a different key in operating position.

FIG. 6 is a view comparable to FIG. 1, with portions broken away and showing a customary key in position.

FIG. 7 is a view comparable to FIG. 6 but showing a special, augmented key in operating position.

DETAILED DESCRIPTION

The present device is in one environment incorporated in a lock 6 in which a driver bar 7 rotates about an axis 8 to actuate the lock. An early version of a lock of this kind is shown in Walter R. Schlage U.S. Pat. No. 2,293,856 of Aug. 25, 1942. The lock driver bar is received in one end of a plug 9 rotatable about the axis 8 and within a housing 11. An extension 12 of the housing has a number of radial bores 13 therein containing springs 14 and upper tumbler pins 16 in the customary way. These bores are likewise, in one position of the plug 9, in alignment with comparable bores 17 in the plug and contain lower pins 18. When properly positioned, the lower pins are designed to cooperate with the upper pins to establish a shear plane so that the plug 9 can be rotated in the housing. Otherwise, some of the pins bridge the shear line and prevent plug rotation.

The plug at one end is axially restrained by an adjustable and locked collar 20 and at the other end is restrained by an integral, extending flange 21. One planar side 22 of the flange abuts the planar end face 23 of the housing, and the other side of the flange is finished to afford a generally planar surface 24 normal to the axis 8. There is a keyway 25 formed in the plug in the customary way, the keyway extending through the front flange 21 and leaving a notch 26 therein located where the keyway 25 extends axially and radially through the extended flange 21. This is customary in plug manufacture.

In the usual lock, as shown in FIG. 6, the plug keyway 25 is adapted to receive a standard key 31 having a bow 32 and an axially extending shank 33. One longitudinal edge 35 of the key shank is provided with serrations 34 interacting directly with the lower pins 18 when the key is in position so as to establish the pin shear line, above mentioned. The other edge 36 of the key is generally rectilinear and is designed to bear against the inside surface of the bore. In its usual configuration, the key 31 has a first shoulder 37 designed substantially to abut against the face 24 when in operating position. Under normal circumstances, rotation of such key rotates the plug and actuates the lock.

Pursuant to the present invention, however, an additional constraint is afforded for the mechanism.

Preferably, the housing 11 is additionally machined in an axial direction to provide an axially limited front opening crescent cut 41 (FIG. 3) open to the bore on one side and to the exterior on the other side. Movable axially within the crescent cut 41 is a detent 42 of a comparable cross-sectional configuration and of somewhat lesser length than the cut 41. The detent is provided with an interior surface 43 acting as a continuation of the housing bore and has an exterior surface 44 acting as a continuation of the housing envelope. With this arrangement the detent is free to slide axially but is not free to rotate due to the constraint of the housing and of the plug. The detent 42 is provided with a spring 46 situated in a pocket 47 in the housing and also in a pocket 48 in the detent. Along the forward edge the detent is especially contoured to provide a projection 49 adapted substantially to occupy the notch 26 when the usual key is used. The projection 49 has a rounded end 51 so that it readily enters into and occupies substantially all of the notch and can be cammed to govern the sliding movement of the detent.

In the operation of this mechanism, when the customary key 31 is inserted into the keyway 25 and fully into its operating position, as shown in FIGS. 4 and 6, there is no effect upon the detent, which stays in its active position with the projection 49 lying fully in the notch 26. Despite the fact that the edge serrations 34 of the key appropriately position all of the pins so that a continuous shear line is available, the key 31 cannot rotate the plug 9. This is because the projection 49 of the detent slide 42 interengages the notch 26 side walls in the plug flange 21 and prevents relative rotation between the plug 9 and the housing 11.

When a special key 53 is introduced into the keyway, there is a different situation. The special key 53 has the customary bow 54 and shank 56 having edge serrations 57 along one edge in exactly the same pattern as the key 31, for example. The special key also has a first shoulder 58 of the usual kind adapted to abut substantially against the end surface 24 of the flange. In addition, however, the special key 53 is augmented by a second, axially extended shoulder 59. This shoulder does not abut the face 24 of the plug flange 21, but rather enters into and occupies the notch 26. In so doing, the augmented shoulder 59 slides or displaces the detent 42 axially to eject the projection 49 from the notch and to compress the spring 46. In this position, the detent provides no restraint on the plug. With the special or augmented key 53 in position, rotation of the plug within the housing is attained. The lock is thus actuated. With very little change in the mechanism there is afforded an additional variation in the key construction and a greater choice in selecting effective keys.

It is particularly of note that it is not easy to alter a standard key 31 to provide the augmented shoulder 59, as this requires the addition of metal, something that is not readily accomplished by the ordinary key shop or locksmith. It is fairly simple to cut a notch into an existing key to avoid a warded cylinder obstruction, yet the necessary addition of metal to a standard key to fit it to this mechanism is less likely and harder to accomplish. The present arrangement is thus somewhat more secure than are some other ways of distinguishing between different keys. Also, the present structure is readily adapted to otherwise standard keys and locks and requires but little alteration in the customary manufacturing process. Furthermore, the augmented shoulder interferes with positioning of the augmented key in some of the customary key duplicating machines, thus making it more difficult to obtain duplicate special or augmented keys. The augmented key itself is readily carried on usual key rings and the like and is as readily handled as a standard key 31. No special technique is required for the use of the augmented key and, in fact, some users do not appreciate that the augmented key is different from standard keys. Yet, the benefits of an additional degree of security and of choice are attained.

I claim:

1. An augmented key and cylinder lock comprising a housing having a bore therein concentric with an axis, a plug in said bore and rotatable around said axis, a flange extending radially outwardly on one end of said plug and overlapping said housing, pin tumbler mechanism in said housing and in said plug, means defining a keyway in said plug extending along said axis and disposed in communication with said pin tumbler mechanism and with said bore, means defining a notch through said flange disposed radially outwardly of said keyway and in communication therewith, a detent on said housing and axially movable between a first position projecting into said notch alongside said keyway and a second position clear of said notch, means for moving said detent to said second position, said moving means comprising a key having a shank movable axially into said keyway and also having a bow and an augmented shoulder merging with said shank and said bow and axially movable into said notch as said shank is fully moved into said keyway.

2. An augmented key and cylinder lock combination comprising a housing having a bore therein concentric with an axis and having an end face normal to said axis, a plug in said bore and rotatable about said axis, a flange on one end of said plug and seated against said end face, means defining a substantially planar end surface on said plug normal to said axis, means defining a keyway in said plug extending along said axis, means defining a notch in said flange and in communication with said keyway, a detent mounted for axial movement on said housing, a projection on said detent adapted to extend free of said keyway and axially into said notch, means for urging said projection into said notch, a bow key having a shank receivable in said keyway and adapted to lie therein in a fully inserted position, means on said key adapted substantially to engage said end surface when said shank is in said position, and means on said key near said bow adapted axially to displace said projection from said notch and substantially to abut said end face when said shank is in said position.

* * * * *